United States Patent [19]

Leem

[11] Patent Number: 4,755,075

[45] Date of Patent: Jul. 5, 1988

[54] WRITING IMPLEMENT WITH TIP HAVING ATTACHING PROJECTIONS

[76] Inventor: Tae Yoon Leem, 204 Ho 52 Dong, Walker Hill Apt., 362, Kawngjang-Dong, Sungdong-Ku, Seoul, Rep. of Korea, 133-00

[21] Appl. No.: 18,414

[22] Filed: Feb. 25, 1987

[51] Int. Cl.[4] ..... B43K 21/08

[52] U.S. Cl. ..... 401/75; 401/86; 401/251

[58] Field of Search ..... 401/75–78, 401/86, 251

[56] References Cited

U.S. PATENT DOCUMENTS

| | | | |
|---|---|---|---|
| 1,051,033 | 1/1913 | Turner | 401/86 X |
| 1,677,415 | 7/1928 | Straka | 401/75 X |
| 2,332,223 | 10/1943 | Hasselquist | 401/86 |
| 4,136,980 | 1/1979 | Leem | 401/75 X |
| 4,610,557 | 9/1986 | Malm | 401/75 |

FOREIGN PATENT DOCUMENTS

| | | | |
|---|---|---|---|
| 2253056 | 5/1974 | Fed. Rep. of Germany | 401/75 |

*Primary Examiner*—Steven A. Bratlie

*Attorney, Agent, or Firm*—Holman & Stern

[57] ABSTRACT

An improved writing implement comprising a barrel having multiple spiral grooves in the inner wall thereof so that a guide element of a carrier within the barrel having a single spiral thread thereon is selectively engaged with one of the multiple spiral grooves, a cap rotatably attachable to one end of the barrel including an insert portion having a protruding ring member projecting from the outer surface of the insert portion engageable with a corresponding ring groove in one end of the barrel, an extension on the cap protruding into the barrel and cooperatively engageable with the carrier so that rotation of the cap rotates and drives the carrier axially within the barrel for moving the lead inwardly or outwardly, and a tip having an insert end with multiple spiral projecting threads thereon cooperatively engageable with the sprial grooves in the barrel.

8 Claims, 2 Drawing Sheets

FIG, 1
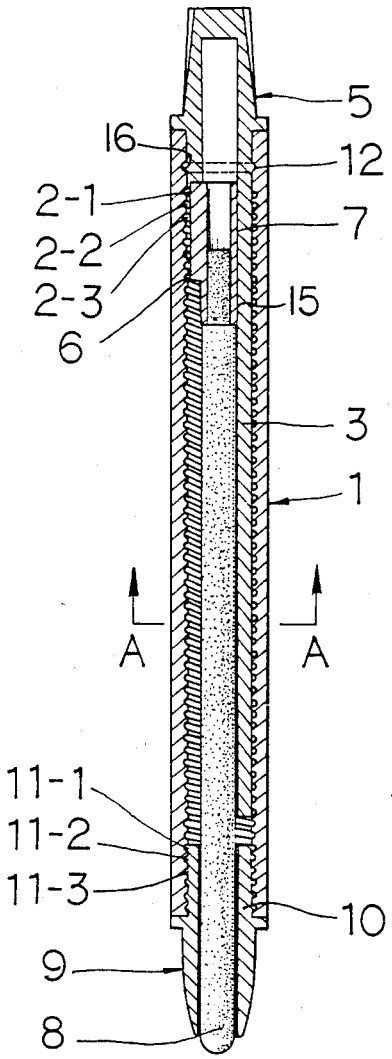
FIG, 3
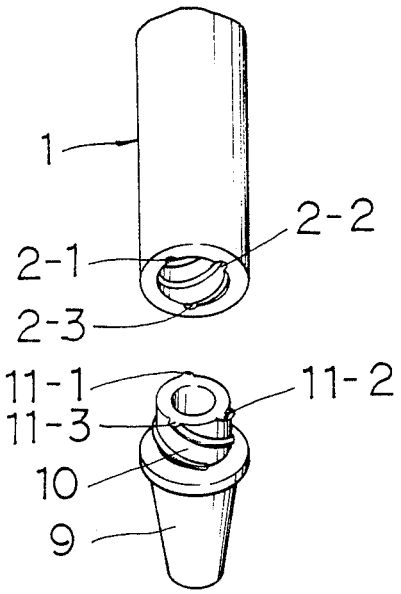
FIG, 2
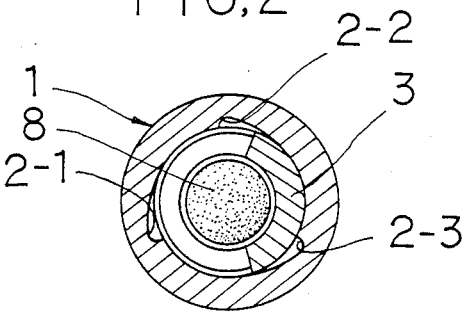

WRITING IMPLEMENT WITH TIP HAVING ATTACHING PROJECTIONS

BACKGROUND OF THE INVENTION

1. Field of the Invention

This invention relates to a mechanical writing implement, and more particulary, to an improvement in the fitting structure of the implement permitting the same to be easily assembled.

2. Description of the Prior Art

A writing implement of the type disclosed in Korean Utility Model Nos. 78-555 and 84-238, which corresponds to U.S. Pat. No. 4,136,980, issued Jan. 30, 1979, both granted to the present inventor, comprises a pencil barrel made of a synthetic resin provided with a single spiral groove on the inner wall thereof; a cap rotatably fitted to one end of the barrel; a carrier provided with a rounded spiral guide on the outward surface thereof, the spiral guide being engaged with for travelling along the spiral groove formed on the inner wall of the barrel to force a pencil lead to move forward or backward; a rotatable tip. And an elongated supporting member on the cap, or tip which cooperates with the carrier. When the cap, or tip, is rotated in one direction, the carrier moves the pencil lead out of the tip opening for use. Similiary, when the cap, or tip, is rotated in the opposite direction, the pencil lead is drawn into the barrel for storage.

The above writing implement, however, has a drawback in that the single spiral groove formed on the inside of the barrel can not be easily aligned with the corresponding spiral protrusion formed on the outward surface of the carrier when the carrier is assembled to the barrel. In addition, a relatively low pitch of the spiral groove of the barrel does not permit the tip, provided with a corresponding single spiral protrusion, to be firmly fitted to its proper position in the one end of the barrel, but it may be accidently disengaged from the barrel in use. For this reason, it is required to provide a special screw thread with dense pitch both in the inside of the barrel and on the outward surface of the inserted portion of the tip so as to secure a firm fitting. This is likely to add to the manufacturing cost in terms of the additional process that is required to form the special screw thread with the dense pitch. In this case, the external screw thread thus formed on the tip also can not be easily aligned with the internal screw thread formed in the inside of the barrel. In addition, a workman must rotate the tip by a full ten rotations provided that the tip has a special screw thread, for example with ten pitches, in order to attain a complete and firm fitting of the tip into the barrel. This also tends to increase the labor cost, thereby adding to the manufacturing cost.

SUMMARY OF THE INVENTION

The primary object of the invention is to provide an improvement in the fitting construction of the prior art writing implement, in which the pencil barrel has multiple spiral grooves in the inner wall thereof, and the presence of the multiple spiral grooves eliminates an additional process for forming a special screw means to secure firm fitting between the barrel and the tip.

Another object of the invention is to provide a writing implement having improved fitting construction in which the tip can be readily and quickly fitted to the barrel.

These and other objects can be attained by a writing implement in accordance with the invention comprising a barrel having multiple, preferably triple, spiral grooves in the inside thereof; and a tip having the corresponding multiple, preferably triple, projections adapted to be fitted to the multiple spiral grooves.

BRIEF DESCRIPTION OF THE DRAWINGS

The present invention will be more throughly described with reference to the accompanying drawings wherein:

FIG. 1 is a longitudinal cross-sectional view of the writing implement of the invention;

FIG. 2 is a cross-sectional view of the writing implement taken generally along the line A—A of FIG. 1;

FIG. 3 is an exploded perspective view of parts of the writing implement shown in FIG. 1, illustrating the engaging mode of the pencil tip and the barrel.

DETAILED DESCRIPTION

Figure 4:
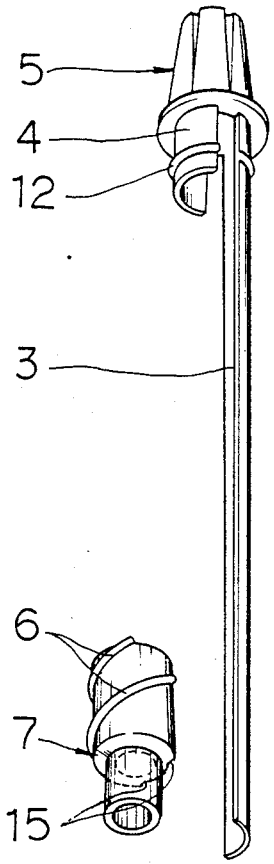
FIG. 4 is an exploded perspective view showing a rotatable cap and a pencil lead carrier member of the invention.

Referring now to FIG. 1, a pencil barrel 1 made of a synthetic resin has preferably triple spiral grooves 2-1, 2-2, 2-3 in the inner wall of the barrel 1. A carrier 7 is provided with a rounded single spiral guide 6 on the outward surface thereof, which spiral guide 6 is selectively engaged with and travels along one of the spiral grooves 2-1, 2-2, 2-3 in the pencil barrel 1. Rotatably fitted to one end of the barrel 1 is a tip 9 which also includes triple spiral protrusions 11-1, 11-2, 11-3 corresponding to said triple spiral grooves 2-1, 2-2, 2-3. A pencil lead can be passed through the opening of the tip 9 forwardly or backwardly. As can be more clearly seen in FIG. 3, the one end of the barrel 1 is provided with the preferably triple spiral grooves 2-1, 2-2, 2-3, into which the corresponding triple spiral protrusions 11-2, 11-2, 11-3 formed on the inserted portion of the tip 9 are received to be rotatably fitted to the barrel 1.

FIGS. 1 and 4 show a protruding holding ring member 12 formed on the outside surface of the cap holder 4, an annular groove 16 on the inner surface of barrel 1 with which the ring member 12 is rotatably fitted, and a recess 15 in the outer surface of the carrier 7 conforming to and slidably receiving therein the supporting member extending from cap 5.

In operating the implement, when the rotatable cap 5 is rotated, the supporting member 3 rotates accordingly and thereby forces the carrier 7 to rotate in the same direction as the rotatable cap by contacting recess 15 in the carrier 7 with the concaved portion of the supporting member 3. Rotation of the carrier causes the rounded spiral guide 6 formed on the outside of the carrier 7 to travel along one of the triple spiral grooves 2-1, 2-2, 2-3 on the inside of the pencil barrel 1. By this operation, the pencil lead 8 is moved outwardly or inwardly with respect to the lead opening in tip 9, as in conventional mechanical pencils.

Since the writing implement thus constructed has triple spiral grooves 2-1, 2-2, 2-3 on the inside of the barrel 1, and the open ends of the grooves 2-1, 2-2, 2-3 are equidistantly spaced with each other at the ends of the barrel 1, approximately one-third rotation of the tip 9 provides sufficient alignment with the triple spiral grooves 2-1, 2-2, 2-3 when the tip 9 is assembled to the barrel 1. A full rotation would be necessary if as aforementioned a single spiral groove in the inside of the barrel 1 is present. Therefore the time required to assemble the tip 9 to the barrel 1 can be substantially reduced.

From the foregoing, it will be appreciated that a writing implement made according to the invention eliminates entirely the need for forming a special screw thread heretofore required in joining a tip to a barrel. It will also be appreciated that the assembly operation is extremely simple thereby minimizing labor requirements. As a consequence, an extremely effective, but economical to manufacture, writing implement results.

Although the present invention has been described with respect to a specific embodiment by referring to the accompaning drawings it should be noted that the invention can be modified by those skilled in the art within the spirit and scope of the invention.

What is claimed is:

1. In a writing implement having an elongated hollow barrel with an inner wall surface, a spiral groove on the inner wall surface, a cap rotatably mounted at one end of the barrel, a part-annular elongated supporting member extending from the cap into the hollow barrel to be rotated within the barrel by rotation of the cap, a tip attachable to the other end of the barrel, a bore through the tip coaxial with the central axis of the barrel to slidingly receive a writing element therein, a carrier within the barrel adapted to engage with the writing element, and a guide element projecting from the outer surface of the carrier engaging in the spiral groove, the carrier engaging with the supporting member so that rotation of the cap and supporting member with respect to the barrel drives said carrier rotatably and axially in said barrel to move the writing element axially through the tip, the improvement comprising:

multiple spiral grooves on the inner wall surface of the barrel so that the guide element of the carrier within the barrel is selectively engageable with one of said multiple spiral grooves;

an insert portion on the tip rotatably attachable in the other end of the barrel; and multiple spiral protrusions projecting from the outer surface of said insert portion corresponding to and engageable with said multiple spiral grooves.

2. The writing implement as claimed in claim 1 wherein:

said guide element on said carrier comprises a single spiral external thread cooperatively engageable in one of said multiple spiral grooves.

3. The writing implement as claimed in claim 2 wherein:

said multiple spiral grooves comprise three spiral grooves; and said multiple spiral protrusions on said insert portion on said tip comprise three spiral protrusions.

4. The writing implement as claimed in claim 3 wherein:

said three spiral grooves and three spiral protrusions are equidistantly circumferentially spaced.

5. The writing implement as claimed in claim 4 wherein said carrier comprises:

a cylindrical member; and an arcuate slot extending axially on the outer surface of said cylindrical member for sliding engagement with the elongated supporting member.

6. The writing implement as claimed in claim 1 wherein:

said multiple spiral grooves comprise three spiral grooves; and said multiple spiral protrusions on said insert portion on said tip comprise three spiral protrusions.

7. The writing implement as claimed in claim 6 wherein:

said three spiral grooves and three spiral protrusions are equidistantly circumferentially spaced.

8. The writing implement as claimed in claim 1 wherein said carrier comprises:

a cylindrical member; and an arcuate slot extending axially on the outer surface of said cylindrical member for sliding engagement with the elongated supporting member.

* * * * *